United States Patent [19]

Aoyama et al.

[11] Patent Number: 5,014,765

[45] Date of Patent: May 14, 1991

[54] HEAT RETAINING METHOD FOR MOLTEN METAL SUPPLIED INTO INJECTION SLEEVE, METHOD OF APPLYING HEAT INSULATING POWDER ONTO AN INNER SURFACE OF THE INJECTION SLEEVE, AND DEVICE THEREFOR

[75] Inventors: Shunzo Aoyama, Wakoh; Kunio Yoshida, Fujimi; Hachiro Doi, Saitama; Katsumi Sakamoto, Ohmiya, all of Japan

[73] Assignee: Ahresty Corporation, Tokyo, Japan

[21] Appl. No.: 356,344

[22] Filed: May 24, 1989

[30] Foreign Application Priority Data

| | | | |
|---|---|---|---|
| May 25, 1988 | [JP] | Japan | 63-129367 |
| May 25, 1988 | [JP] | Japan | 63-129368 |
| Dec. 29, 1988 | [JP] | Japan | 63-171400 |
| Jan. 31, 1989 | [JP] | Japan | 1-23440 |

[51] Int. Cl.[5] ..... B22D 17/20

[52] U.S. Cl. ..... 164/72; 164/113; 164/267; 164/312

[58] Field of Search ..... 164/72, 74, 48, 113, 164/149, 250.1, 495, 514, 138, 312, 267

[56] References Cited

U.S. PATENT DOCUMENTS

| | | | |
|---|---|---|---|
| 3,735,797 | 5/1973 | Jeanneret | 164/72 |
| 4,425,411 | 1/1984 | Textor et al. | 164/72 |
| 4,738,297 | 4/1988 | Takagi et al. | 164/72 |

FOREIGN PATENT DOCUMENTS

| | | | |
|---|---|---|---|
| 63-137539 | 6/1988 | Japan | 164/72 |

*Primary Examiner*—Richard K. Seidel

*Attorney, Agent, or Firm*—Watson, Cole, Grindle & Watson

[57] ABSTRACT

Molten metal is prevented from cooling too quickly when supplied to an injection sleeve of a casting device by applying a heat insulating powder onto an inner surface of the injection sleeve between each supply of molten metal. The heat insulating powder can be applied to the inner surface of the injection sleeve by way of an electrostatic field created between an electrode which has been inserted into the injection sleeve and the injection sleeve itself.

3 Claims, 10 Drawing Sheets

HEAT RETAINING METHOD FOR MOLTEN METAL SUPPLIED INTO INJECTION SLEEVE, METHOD OF APPLYING HEAT INSULATING POWDER ONTO AN INNER SURFACE OF THE INJECTION SLEEVE, AND DEVICE THEREFOR

FIELD OF THE INVENTION AND RELATED ART STATEMENT

The present invention relates to a method of retaining heat of a molten metal supplied into an injection sleeve in a casting apparatus such as a die casting machine for casting the molten metal injected from the injection sleeve into a cavity of a die, and also relates to a method and device for applying a heat insulating powder onto an inner surface of the injection sleeve, so as to retain the heat of the molten metal supplied into the injection sleeve.

The molten metal supplied into the injection sleeve by a molten metal supplying device is quickly reduced in temperature. Therefore, unless the molten metal supplied into the injection sleeve is quickly injected and charged into the cavity of the die, it tends to be partially hardened to cause defective charge or defects of casting surface. However, if an injection speed of the molten metal to be injected from the injection sleeve is too high, gas (air or the like) in the injection sleeve will be drawn into the molten metal to cause the generation of blow hole or pin hole in castings.

Accordingly, in order to efficiently produce castings having a high quality without the defects of casting surface, the blow hole, etc., it is important to retain the heat of the molten metal supplied into the injection sleeve so as not to harden the molten metal for a given period of time (several seconds until the molten metal is injected into the cavity of the die).

Conventionally, there have been proposed various methods for preventing the hardening of the molten metal in the injection sleeve by:

(1) Forming the injection sleeve from ceramics having a high heat insulating property;

(2) Constructing the injection sleeve into a hot chamber;

(3) Suppressing the contact between the injection sleeve and the molten metal such as by vertical injection; and (4) Externally heating the injection sleeve.

However, as the above method (1) has a problem in shock resistance, it is not put to practical use at present. The method (2) may be applied to a molten metal having a low melting point such as zinc, but it is not practically applied to a molten metal having a high melting point such as aluminum. The method (3) is practically ineffective, and the method (4) is difficult in maintenance and control to result in low productivity.

Accordingly, the present invention provides a method of retaining the heat of the molten metal supplied into the injection sleeve so as not to harden the molten metal for a given period of time until the molten metal is injected into the cavity of the die, by applying a heat insulating powder onto an inner surface of the injection sleeve.

There have been considered various methods for applying the heat insulating powder onto the inner surface of the injection sleeve, such as by a spray method using gas (air or the like) as a carrier, by rubbing or striking a bag containing the heat insulating powder against the inner surface of the injection sleeve like a Rosin bag. However, the spray method and the Rosin bag method as mentioned above have shortcomings such that uniform application of the heat insulating powder onto the inner surface of the injection sleeve is very hard, and that the working efficiency is reduced. In an electrostatic coating method wherein the heat insulating powder preliminarily charged is blasted into the injection sleeve, a density of powder spray is higher near a blasting hole where the powder is blasted, and it is lower at positions farther from the blasting hole. Thus, uniform application of the heat insulating powder onto the inner surface of the injection sleeve is very hard. Further, even in the case of using a conventional spray gun for electrostatic coating, the spray gun cannot be inserted into the injection sleeve because a size of the spray gun is larger than an inner diameter of the injection sleeve. Accordingly, the heat insulating powder is obliged to be sprayed from the outside of the injection sleeve. Thus, uniform application of the heat insulating powder onto the inner surface of the injection sleeve is hard.

OBJECT AND SUMMARY OF THE INVENTION

It is an object of the present invention to provide a heat retaining method for a molten metal which may easily and effectively retain heat of the molten metal supplied into an injection sleeve so as not to harden the molten metal for a given period of time (several seconds until the molten metal is injected into a cavity of a die) and prevent any adverse affect upon castings.

It is another object of the present invention to provide a method and device for applying a heat insulating powder which may apply the heat insulating powder onto an inner surface of the injection sleeve easily, reliably and uniformly, so as to retain the heat of the molten metal supplied into the injection sleeve.

According to one aspect of the present invention, there is provided in a casting device including an injection sleeve to be supplied with a molten metal, and a die defining a cavity into which the molten metal is injected from the injection sleeve; a method of retaining heat of the molten metal in the injection sleeve, comprising the steps of applying a heat insulating powder onto an inner surface of the injection sleeve, and then supplying the molten metal into the injection sleeve.

According to another aspect of the present invention, there is provided in a casting device including an injection sleeve to be supplied with a molten metal, and a die defining a cavity into which the molten metal is injected from the injection sleeve; a method of applying a heat insulating powder onto an inner surface of the injection sleeve, comprising the steps of inserting one of positive and negative electrodes connected to a high-voltage generator into the injection sleeve, supplying the heat insulating powder into the injection sleeve, electrically connecting the other electrode to the injection sleeve, and generating an electrostatic field between the one electrode and the injection sleeve to thereby charge the heat insulating powder in the injection sleeve, whereby the heat insulating powder charged is deposited onto said inner surface of said injection sleeve.

According to a further aspect of the present invention, there is provided in a casting device including an injection sleeve to be supplied with a molten metal, and a die defining a cavity into which the molten metal is injected from said injection sleeve; a device for applying a heat insulating powder onto an inner surface of the injection sleeve, comprising a high-voltage generator, positive and negative electrodes connected to the high-voltage generator, an electrode moving mechanism for moving one of the electrodes into and out of the injection sleeve, and a heat insulating powder supplying mechanism for supplying the heat insulating powder into the injection sleeve, wherein the other electrode is electrically connected to the injection sleeve, and an electrostatic field is generated by the high-voltage generator between the inner surface of the injection sleeve and the one electrode inserted into the injection sleeve by the electrode moving mechanism to thereby deposit the heat insulating powder supplied into the injection sleeve by the supplying mechanism onto the inner surface of the injection sleeve.

DETAILED DESCRIPTION OF THE PREFERRED EMBODIMENTS

Figure 1:
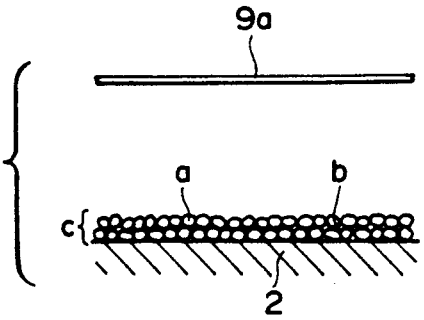
FIG. 1 is an enlarged sectional view of a heat insulating layer formed by the heat insulating powder applied onto the inner surface of the injection sleeve according to the present invention.

The heat retaining method for a molten metal in an injection sleeve according to the present invention is featured by applying a heat insulating powder onto an inner surface of the injection sleeve each time before the molten metal is supplied into the injection sleeve. As shown in FIG. 1, the application of the heat insulating powder onto the inner surface of the injection sleeve 2 causes formation of a heat insulating layer c consisting of a heat insulating powder a and an air gap (air layer) b on the inner surface of the injection sleeve 2. The formation of the heat insulating layer c prevents direct contact of the molten metal with the inner surface of the injection sleeve 2 after the molten metal is supplied into the injection sleeve 2. Additionally, the heat insulating layer c has a heat insulating and retaining property. Thus, the double effects of the heat insulating layer c contribute to heat retention of the molten metal in the injection sleeve 2. While a thickness of the heat insulating layer c depends on a particle size of the heat insulating powder a, it is not specifically limited but preferably set to be as thin as possible to a degree such that the heat of the molten metal supplied into the injection sleeve 2 may be retained so as not harden the molten metal for a given period of time (several seconds until the molten metal is injected into a cavity 8 of a die). The particle size of the heat insulating powder is preferably set to be not greater than about 0.2 mm because a large particle size of the heat insulating powder applied on the inner surface of the injection sleeve causes easy separation from the inner surface of the injection sleeve.

The heat insulating powder to be used in the present invention may be selected from any kinds of powder not reacting with the molten metal. Examples of such powder include an electricity charging powder such as boron and talc; a metallic powder such as metal oxide, metal sulfide and metal nitride; or a mixed powder as a mixture of the above powder with a resin powder. Preferably, a self-lubricating powder having a self-lubricating property in a powder state may be used from the viewpoint of improvement in slidability of a plunger tip 7 adapted to slide on the inner surface of the injection sleeve 2. More specifically, the heat insulating powder may be selected from stearates of sodium, magnesium, zinc and calcium; resin powder such as fluoro resin, phthalocyanine, polyethylene and polypropylene; self-lubricating materials such as indium, lead, lead oxide and molybdenum disulfide; metal oxides such as $Na_2O$, BeO, MgO, $Al_2O_3$, $SiO_2$, CaO, $TiO_2$, $Cr_2O_3$, $MnO_2$, $Fe_2O_3$, FeO, MnO and PbO; a mixture thereof such as talc, spinel and mullite; or any other compounds such as WC, TiN, TiC, $B_4C$, TiB, ZnC, SiC, $Si_3N_4$, BN and graphite. These kinds of powder may be used solely or in combination.

The method of applying the heat insulating powder onto the inner surface of the injection sleeve may be selected from a spray method using a carrier gas such as air, an electrostatic coating method utilizing static electricity, or a method of rubbing or striking a bag containing the heat insulating powder like a Rosin bag. In these methods, the electrostatic coating method is preferable for the reason that the heat insulating powder can be easily applied with a uniform thickness.

There will now be described some preferred embodiments of the method and device for coating the heat insulating powder onto the inner surface of the injection sleeve with reference to the drawings.

FIGS. 2 to 5 show a first preferred embodiment of the coating device according to the present invention, and FIGS. 8 to 19 show the other preferred embodiments of the coating device according to the present invention, wherein the same or corresponding parts throughout the drawings are designated by the same reference numerals. It will be understood from the following description that the present invention is not limited to the preferred embodiments as shown.

Reference character A designates a known die casting machine generally constructed of a fixed plate 1, an injection sleeve 2 and a fixed die 3 both mounted to the fixed plate 1, a movable plate 4 and a movable die 5 mounted to the movable plate 4. After the movable die 3 and the fixed die 5 are closed, a molten metal is supplied from an inlet 6 of the injection sleeve 2, and is injected into a cavity 8 of the die by a plunger tip 7, thus obtaining a desired casting.

In applying the heat insulating powder onto the inner surface of the injection sleeve 2 before supplying the molten metal into the injection sleeve 2, a positive or negative electrode 9a connected to a high-voltage generator 9 is inserted into the injection sleeve 2, and the other electrode 9b connected to the high-voltage generator 9 is electrically connected to the injection sleeve 2. Then, after or while the heat insulating powder is blasted into the injection sleeve 2, a high voltage is applied between the inner surface of the injection sleeve 2 and the electrode 9a inserted into the injection sleeve 2, so as to charge the heat insulating powder in the injection sleeve 2, thus depositing the heat insulating powder into the inner surface of the injection sleeve 2.

The coating device according to the present invention includes the high-voltage generator 9, the positive and negative electrodes connected to the high-voltage generator 9, an electrode moving mechanism 10 for moving the positive or negative electrode 9a into and out of the injection sleeve 2, and a heat insulating powder supplying mechanism 11 for supplying the heat insulating powder into the injection sleeve 2.

The high-voltage generator 9 is a known one capable of generating a high voltage of about 10–100 KV between the positive and negative electrodes connected to a high-voltage controller. The high-voltage generator 9 is located on the fixed plate 1 of the die casting machine A. The positive or negative electrode 9a is adapted to be inserted into the injection sleeve 2 by the electrode moving mechanism 10 in such a manner that the electrode 9a does not electrically contact the injection sleeve 2, or preferably it is substantially aligned with an axis of the injection sleeve 2 when it is inserted therein. The polarity of the electrodes 9a and 9b is dependent upon an electrical property (polarity) of the heat insulating powder to be used. While the electrode 9b may be directly connected to the injection sleeve 2, it is preferably connected to the fixed plate 1 since the injection sleeve 2 and the fixed plate 1 supporting the same are normally formed of a conductive metal material.

The electrode moving mechanism 10 for moving the electrode 9a into and out of the injection sleeve 2 may have various embodiments. The first preferred embodiment of the electrode moving mechanism 10 as shown in FIGS. 2 to 5 includes a pair of rails 12a mounted on a base plate 12 fixed on the fixed plate 1 of the die casting machine A, an arm 13 mounted on the rails 12a so as to be horizontally movable by a cylinder 14, and a driving cylinder 15 mounted to the arm 13 so as to be pivotable about a pivotal shaft 16. The arm 13 is provided at its lower end 13a with a gently arcuate guide plate 17 depending toward the molten metal inlet 6 of the injection sleeve 2. A rod 15a of the driving cylinder 15 is provided at its end with a supporting member 19 having guide rollers 18 for supporting the guide plate 17. That is, the supporting member 19 is movable by the rod 15a along the guide plate 17 through the guide rollers 18. The electrode 9a is mounted to the supporting member 19, and depends therefrom along the guide plate 17. Thus, the electrode 9a can be moved with the supporting member 19 along the guide plate 17 by the rod 15a of the driving cylinder 15 so as to be inserted from the inlet 6 into the injection sleeve 2. The electrode 9a has a length substantially equal to that of the injection sleeve 2, and is formed of a conductive material having a certain rigidity. The supported end of the electrode 9a at the supporting member 19 is electrically connected through a cord 20 to the high-voltage generator 9 located on the fixed plate 1 of the die casting machine A. The horizontally movable construction of the arm 13 is intended to prevent that the guide plate 17 depending from the arm 13 and the electrode 9a extending along the guide plate 17 will hinder the supply of the molten metal from the inlet 6 into the injection sleeve 2. As another construction for preventing such hindrance, the arm 13 may be constructed to be vertically movable.

Figure 5:
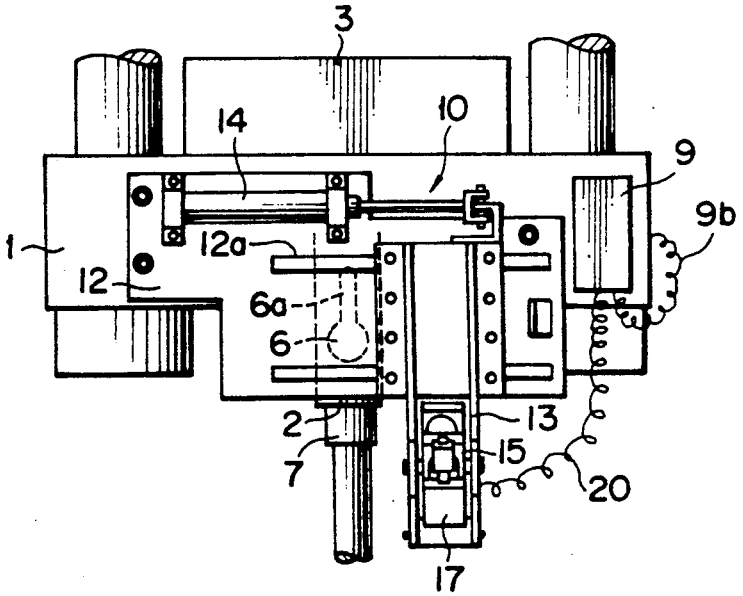
FIG. 5 is a plan view of an essential part of FIG. 3, illustrating the condition where an arm of the electrode moving mechanism is horizontally moved from a position just over the injection sleeve.
Figure 6:
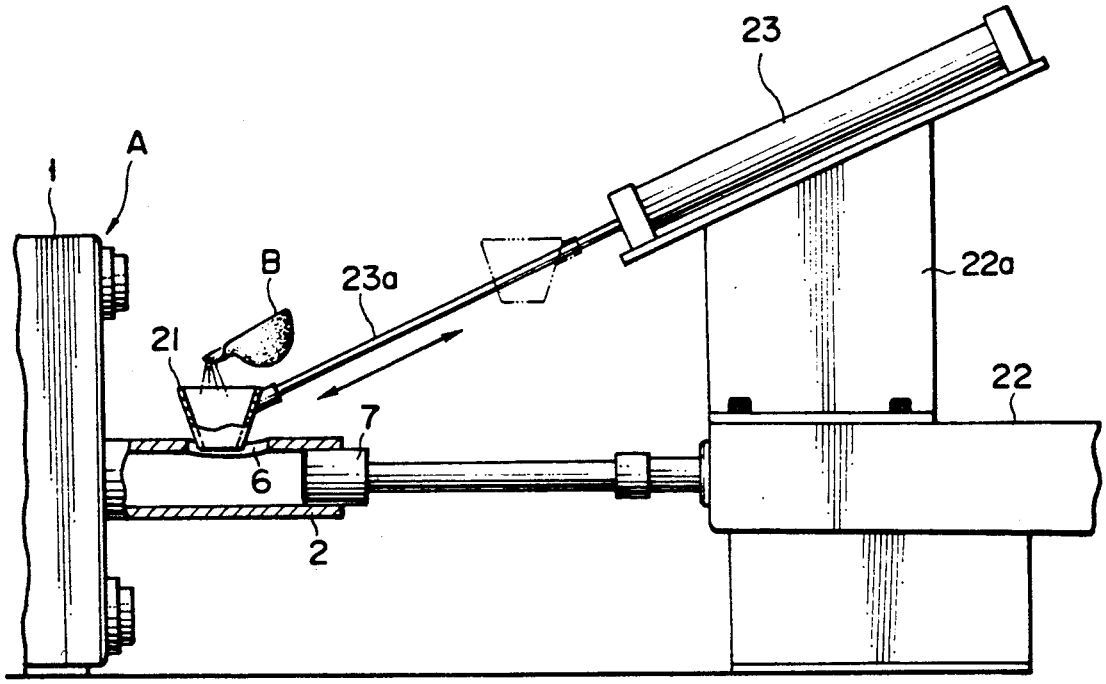
FIG. 6 is a partially sectional elevation of a preferred embodiment of the molten metal supplying device according to the present invention.
Figure 7:
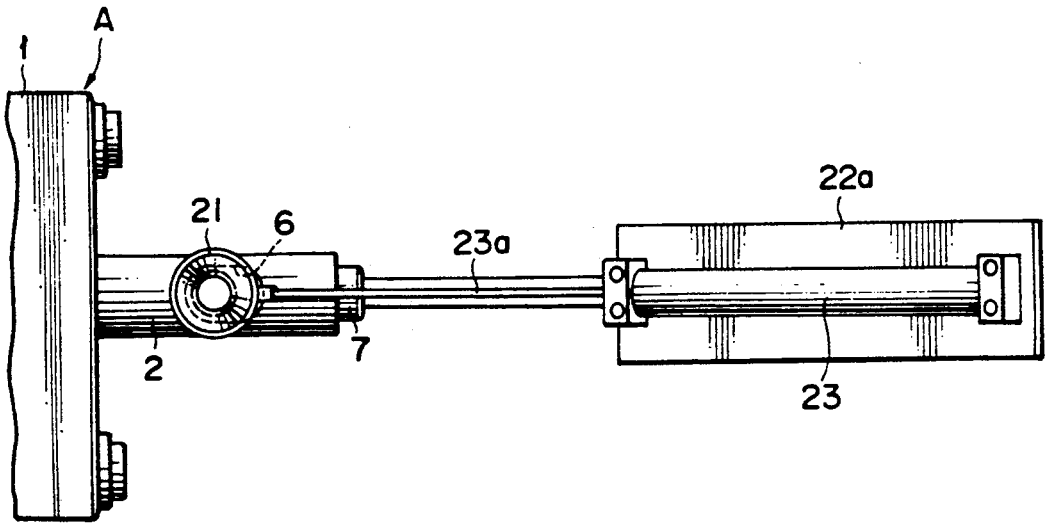
FIG. 7 is a plan view of FIG. 6.

For the purpose of making easy the insertion of the electrode 9a or the heat insulating powder supplying mechanism 11 from the inlet 6 of the injection sleeve 2, it is preferable to form the inlet 6 into an elliptical shape in plan having a major axis along the axis of the injection sleeve 2. Alternatively, as shown in FIG. 5, the inlet 6 is preferably formed with a recess 6a elongated along the axis of the injection sleeve 2. Furthermore, for the purpose of making easy the supply of the molten metal from the inlet 6 into the injection sleeve 2, it is preferable to provide a molten metal hopper 21 adapted to be fitted with the inlet 6. Simultaneously, for the purpose of preventing that the hopper 21 will hinder the insertion of the electrode 9a and the heat insulating powder supplying mechanism 11, the hopper 21 is retractably mounted. That is, referring to FIGS. 6 and 7, a hydraulic cylinder 23 having a rod 23a is mounted through a mounting plate 22a on an injection cylinder 22, and the hopper 21 is provided at an end of the rod 23a. The hopper 21 is moved by the hydraulic cylinder 23 to advance to and retract from the inlet 6 of the injection sleeve 2 in synchronism with a molten metal supplying timing of a ladle (molten metal supplying device) B.

Figure 2:
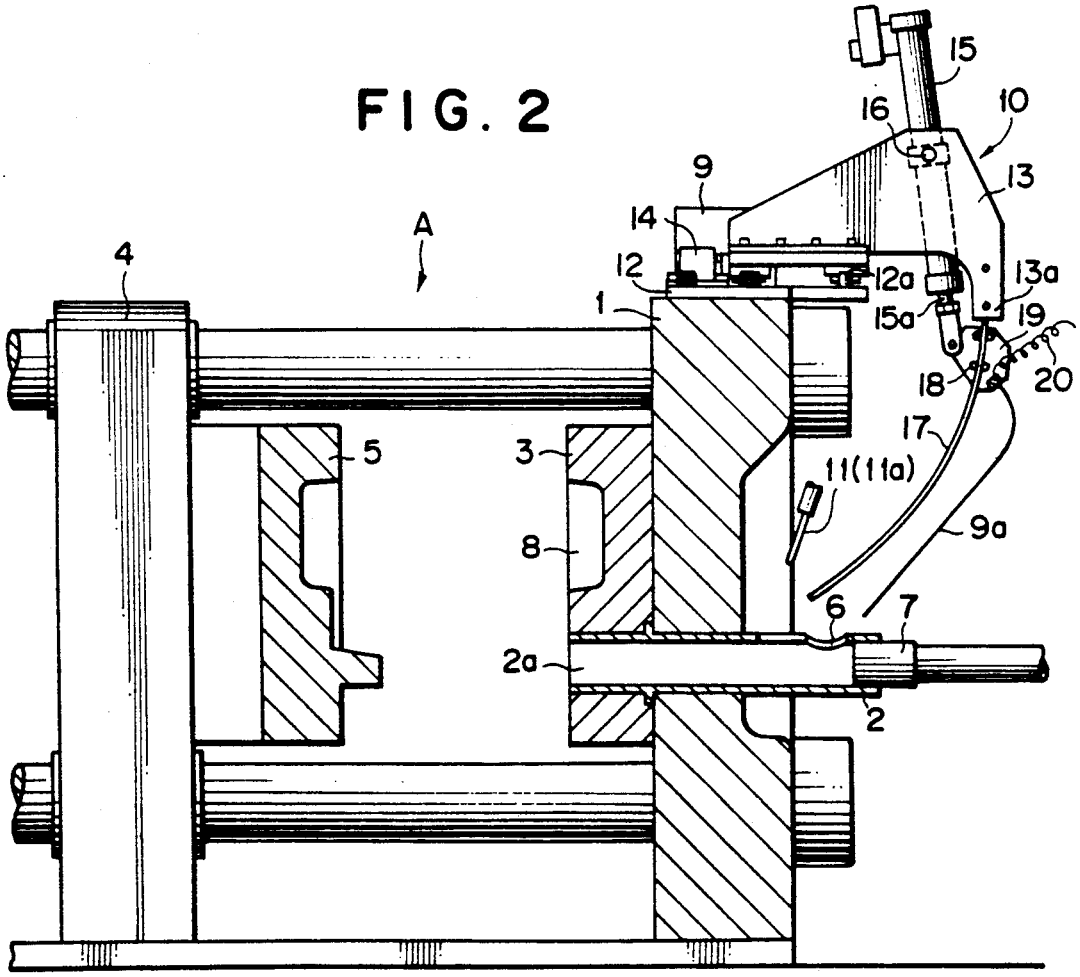
FIG. 2 is a sectional view of a first preferred embodiment of the coating device according to the present invention under the condition where one of the electrodes connected to the high-voltage generator has not yet been inserted into the injection sleeve.
Figure 3:
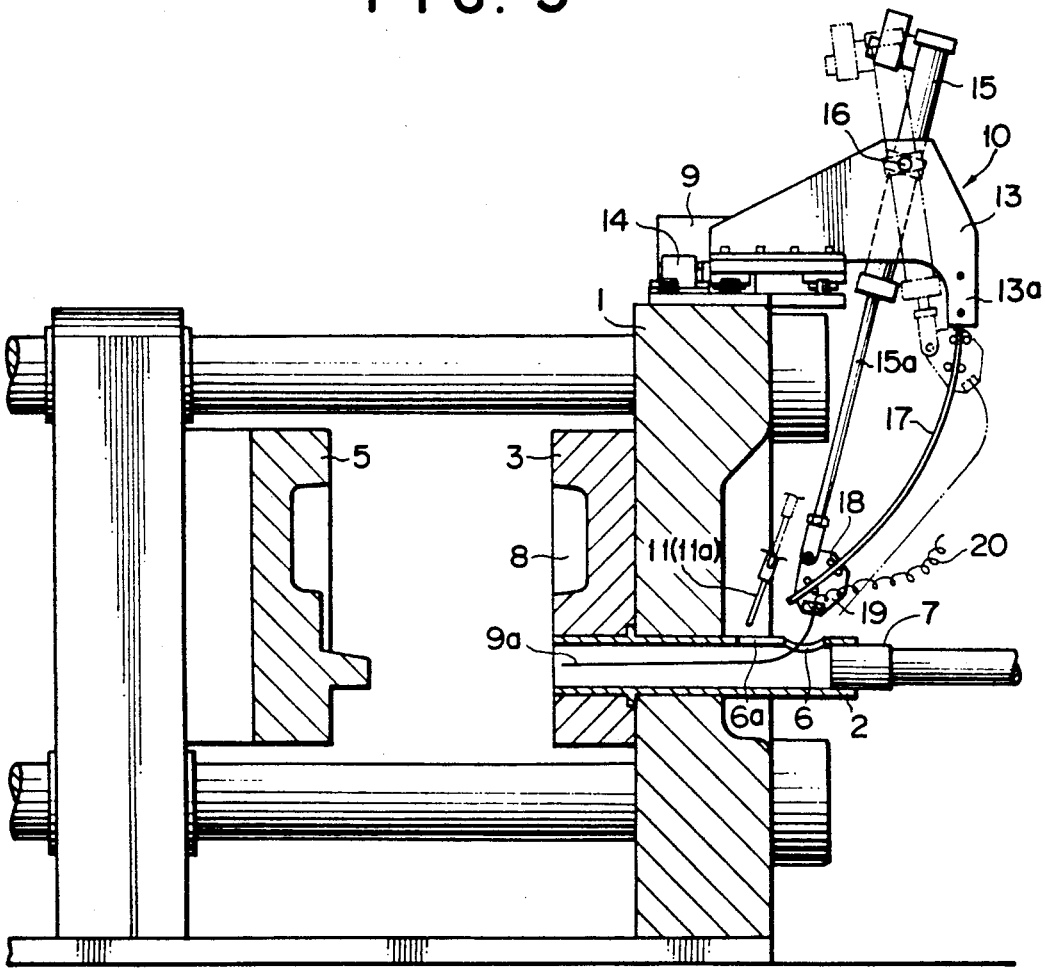
FIG. 3 is a view similar to FIG. 2, illustrating the condition where the one electrode has been inserted into the injection sleeve.
Figure 4:
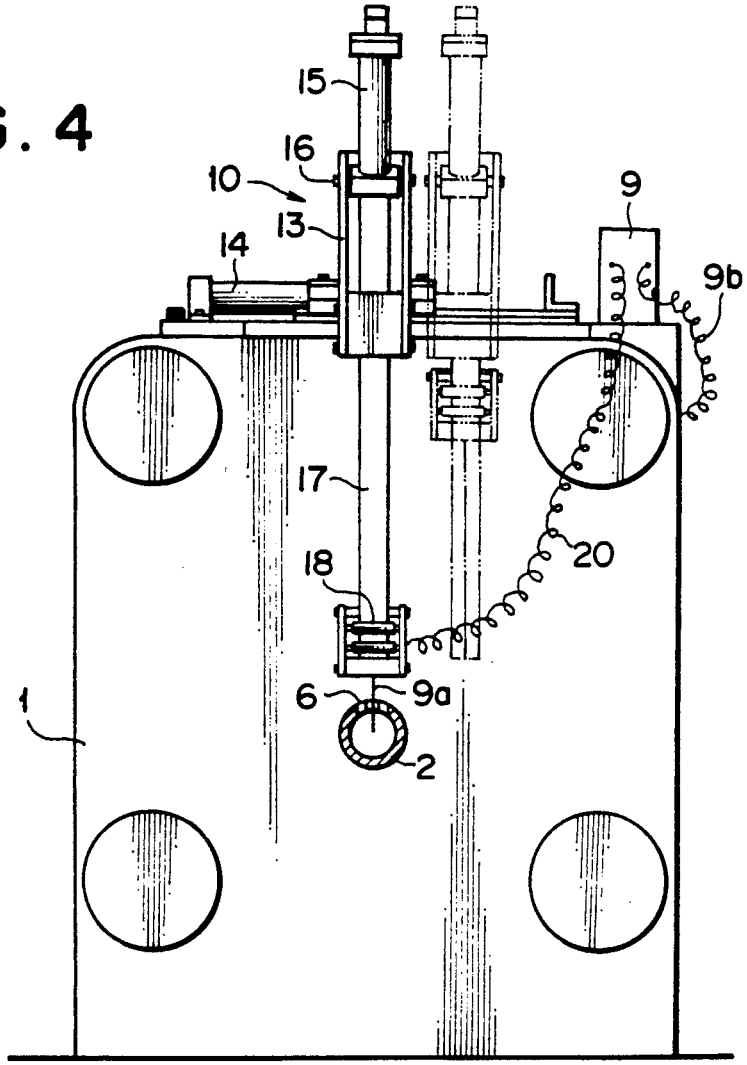
FIG. 4 is a side view of FIG. 3.

In operation, the arm 13 is horizontally moved by the cylinder 14 to a position just over the injection sleeve 2 (as shown in FIG. 2). Then, the rod 15a of the driving cylinder 15 is extended to move the supporting member 19 mounted at the lower end of the rod 15a to the lower end of the guide plate 17 as being guided by the guide plate 17 (as shown in FIG. 3). At the same time, the electrode 9a mounted at its one end to the supporting member 19 is inserted from the inlet 6 into the injection sleeve 2. Conversely, when the rod 15a of the driving cylinder 15 is retracted to the original condition, the electrode 9a is pulled out of the inlet 6 of the injection sleeve 2 in a manner reversed to the above, thus restoring the original condition shown in FIG. 2.

Figure 19:
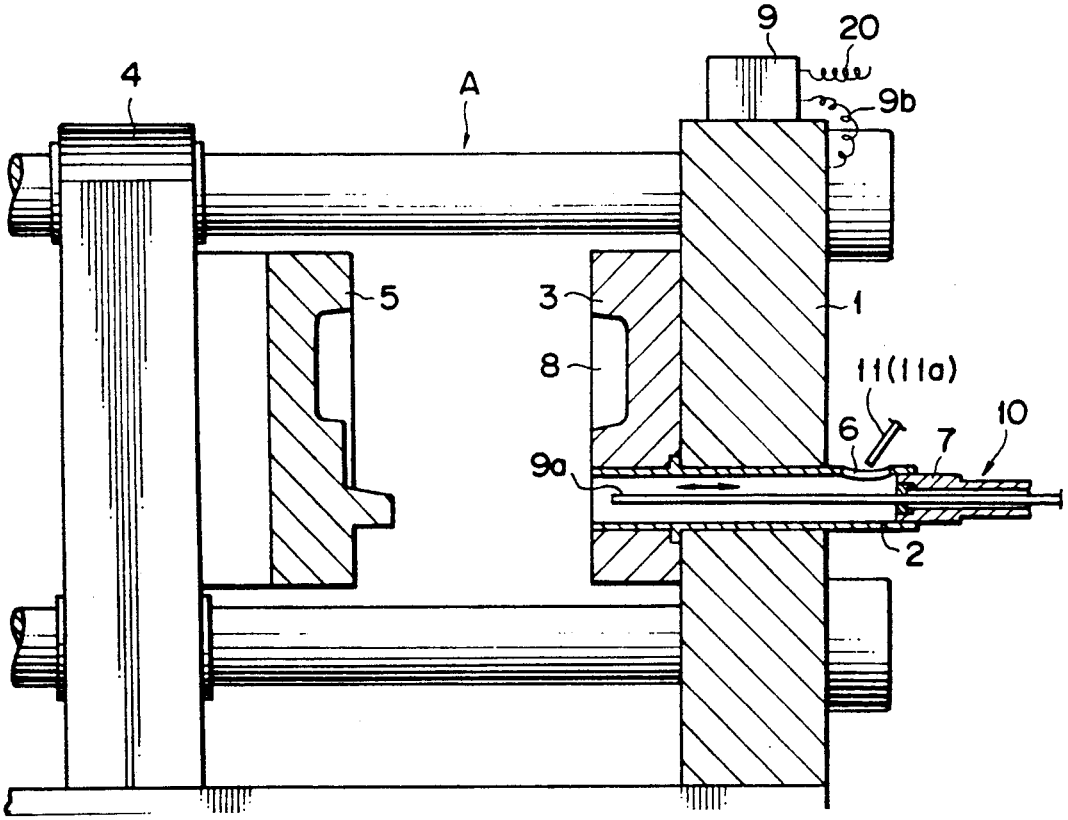
FIGS. 17 to 19 are sectional views of tenth to twelfth preferred embodiments of the coating device according to the present invention, respectively.
Figure 18:
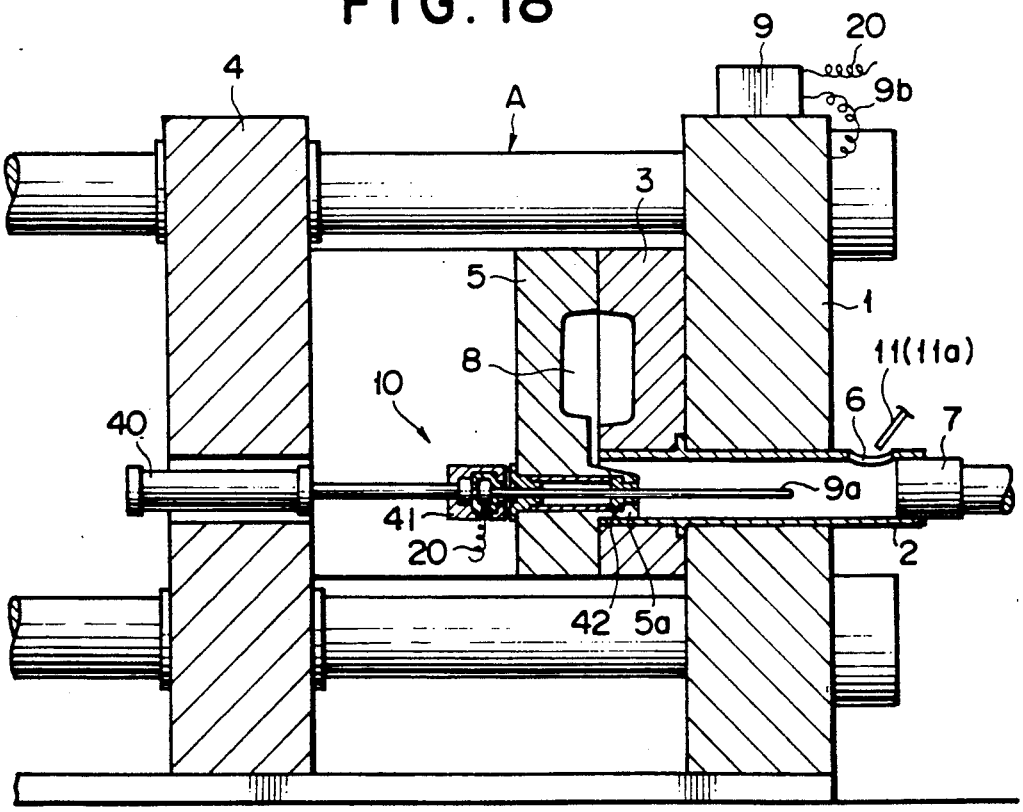

Although the electrode 9a is inserted from the molten metal inlet 6 into the injection sleeve 2 in the above preferred embodiment, a dedicated insertion hole for inserting the electrode 9a may be independently formed through the injection sleeve 2. As will be hereinafter described, the electrode 9a may be inserted from an injection opening 2a of the injection sleeve 2 as shown in FIGS. 8 to 14 (corresponding to second to eighth preferred embodiments, respectively). In further modifications, the electrode 9a may be inserted from the movable die 5 side as shown in FIG. 18 (corresponding to an eleventh preferred embodiment), or it may be inserted from the plunger tip 7 side as shown in FIG. 19 (corresponding to a twelfth preferred embodiment).

The heat insulating powder supplying mechanism 11 for supplying the heat insulating powder into the injection sleeve 2 is constructed of a supply source of the heat insulating powder, a pumping device for pumping the heat insulating powder from the supply source, and a nozzle 11a for blasting the heat insulating powder into the injection sleeve 2 (the nozzle 11a only is shown in the drawings). In blasting the heat insulating powder from the nozzle 11a, the nozzle 11a is disposed at a blasting hole formed through the injection sleeve 2, or it is inserted from the blasting hole. Under the condition, the heat insulating powder is blasted from the nozzle 11*a* into the injection sleeve 2. Alternatively, as pulling the nozzle 11*a* once inserted into the injection sleeve 2 out of the blasting hole, the heat insulating powder may be blasted from the nozzle 11*a*. Although the molten metal inlet 6 is utilized as the blasting hole in the preferred embodiment, the injection opening 2*a* may be utilized as the blasting hole, or a dedicated hole may be independently formed through the injection sleeve 2 for the blasting hole. Further, for the purpose of improving a blasting efficiency of the heat insulating powder, the nozzle 11*a* may be provided with a diffuser. Moreover, two or more blasting holes may be formed to simultaneously or independently or intermittently blast the heat insulating powder therefrom. In modification, one of two blasting holes formed at opposite positions may be dedicated for blasting of the heat insulating powder, while the other blasting hole may be dedicated for suction of the powder.

Thus, the electrode 9*a* connected to the high-voltage generator 9 is first inserted into the injection sleeve 2 by means of the electrode moving mechanism 10. Then, while or after the heat insulating powder is blasted into the injection sleeve 2 by means of the heat insulating powder supplying mechanism 11 (the nozzle 11*a*), a high voltage is applied between the electrode 9*a* and the other electrode 9*b* (the injection sleeve 2) by means of the high-voltage generator 9, thereby generating an electrostatic field between the inner surface of the injection sleeve 2 and the electrode 9*a* and charging the heat insulating powder in the injection sleeve 2. As a result, the charged powder is momentarily deposited onto the inner surface of the injection sleeve 2 to form the heat insulating layer c consisting of the heat insulating powder a and the air gap (air layer) b as shown in FIG. 1. Thereafter, the electrode 9*a* is pulled out of the injection sleeve 2 by means of the electrode moving mechanism 10, and the molten metal is then supplied into the injection sleeve 2. Then, the molten metal in the injection sleeve 2 is injected into the cavity 8 of the die by means of the plunger tip 7, thus obtaining a desired casting. Accordingly, the application of the heat insulating powder onto the inner surface of the injection sleeve 2 is carried out every casting cycle (every time the casting is carried out).

There will now be described some other preferred embodiments of the present invention with reference to FIGS. 8 to 19, wherein the construction of the electrode moving mechanism 10 is variously modified, and the other constructions are the same as those in the first preferred embodiment. Throughout the drawings, the same or corresponding parts as those in the first preferred embodiment are designated by the same reference numerals, and the explanation as to the same constructions will be omitted hereinafter.

Figure 8:
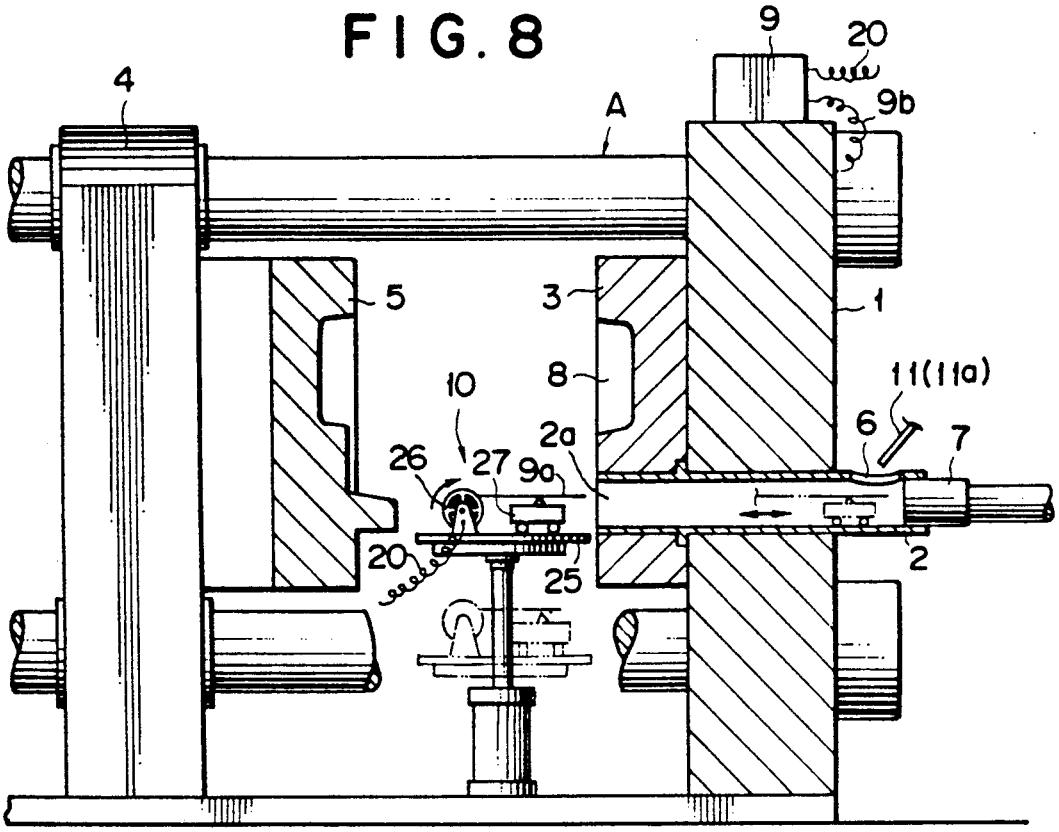
FIGS. 8 to 15 are sectional views of second to ninth preferred embodiments of the coating device according to the present invention, respectively.

Referring first to FIG. 8 which shows a second preferred embodiment, the electrode moving mechanism 10 includes a lift table 25 adapted to be lifted to the same level as the injection opening 2*a* of the injection sleeve 2, a reel 26 fixedly mounted on the lift table 25 for winding the electrode 9*a* electrically connected through the cord 20 to the high-voltage generator 9, and a conveyor vehicle 27 disposed on the lift table 25 for conveying the electrode 9*a* from the injection opening 2*a* into the injection sleeve 2 and also retracting the electrode 9*a* out of the injection sleeve 2.

In operation, when both the dies 3 and 5 of the die casting machine A are open, the lift table 25 is lifted to substantially the same level as the injection opening 2*a* of the injection sleeve 2. Then, the conveyor vehicle 27 is self-traveled or the reel 26 is unwound to thereby advance the conveyor vehicle 27 into the injection sleeve 2. As a result, the electrode 9*a* wound around the reel 26 is unwound and is conveyed by the conveyor vehicle 27 into the injection sleeve 2, thus effecting insertion of the electrode 9*a* into the injection sleeve 2. After completion of application of the heat insulating powder onto the inner surface of the injection sleeve 2 in the same manner as the first preferred embodiment, the electrode 9*a* is rewound around the reel 26, and the conveyor vehicle 27 is retracted out of the injection sleeve 2 to the lift table 25, thereby pulling the electrode 9*a* out of the injection sleeve 2. Then, the lift table 25 is lowered.

Figure 9:
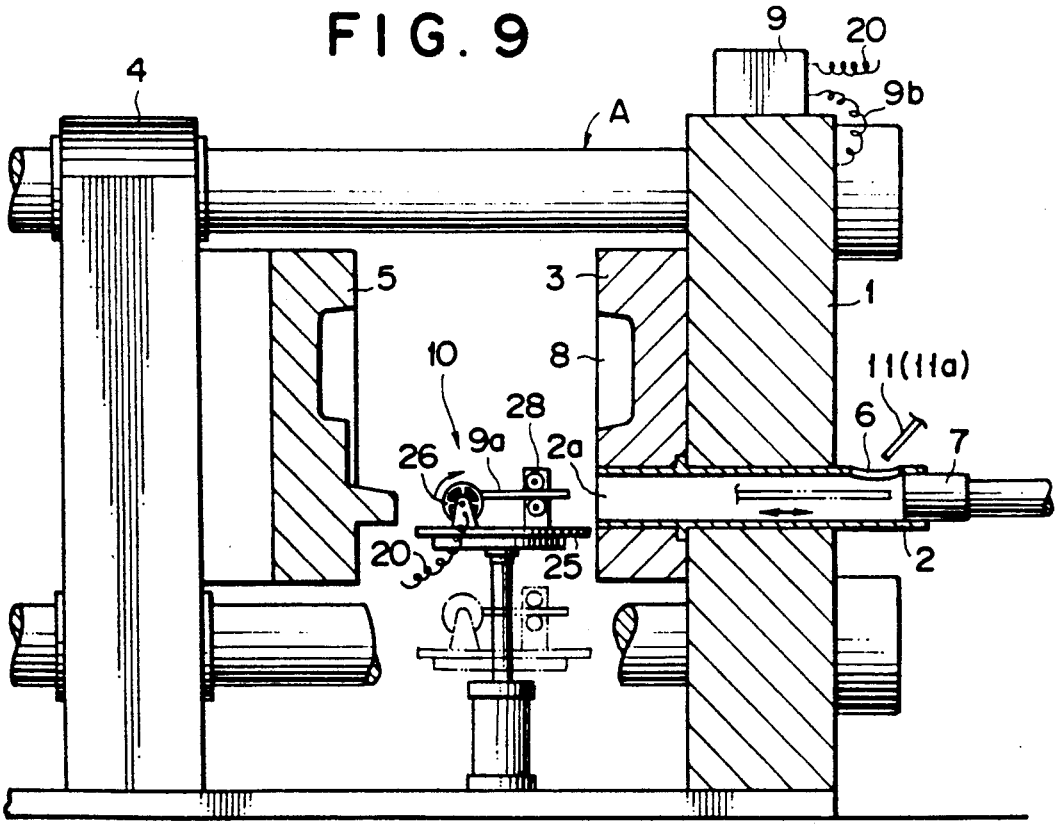

Referring to FIG. 9 which shows a third preferred embodiment of the present invention as modified from the second preferred embodiment, the electrode moving mechanism 10 excludes the conveyor vehicle used in the second preferred embodiment but includes an electrode feeder 28 fixedly mounted on the lift table 25 for feeding the electrode 9*a* unwound from the reel 26. In feeding the electrode 9*a*, the electrode feeder 28 deforms the electrode 9*a* into a substantially sectional V-shape so as to prevent the electrode 9*a* inserted into the injection sleeve 2 from bending or flexing.

Figure 10:
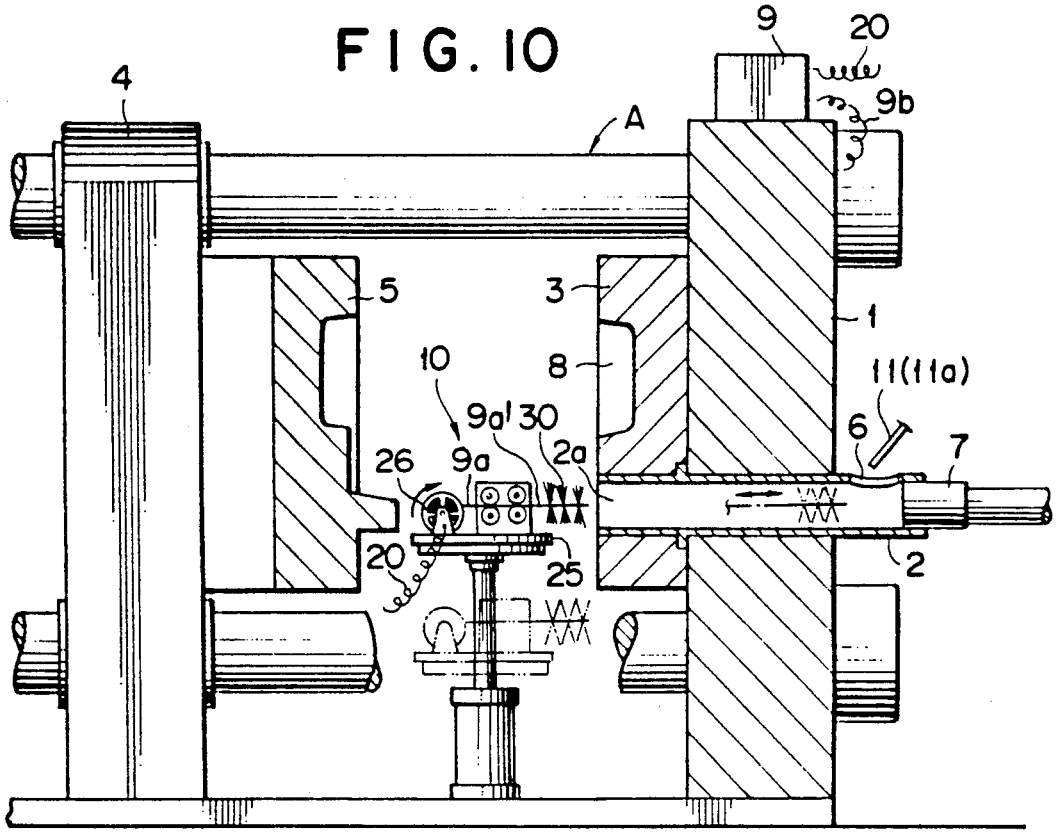

Referring to FIG. 10 which shows a fourth preferred embodiment of the present invention as modified from the third preferred embodiment, a brush-like electrical insulating support 30 is provided at a free end 9'*a* of the electrode 9*a* in such a manner as to extend radially. With this construction, the electrode 9*a* inserted into the injection sleeve 2 is supported by the brush-like electrical insulating support 30 to maintain the horizontally extending condition of the electrode 9*a*.

Figure 11:
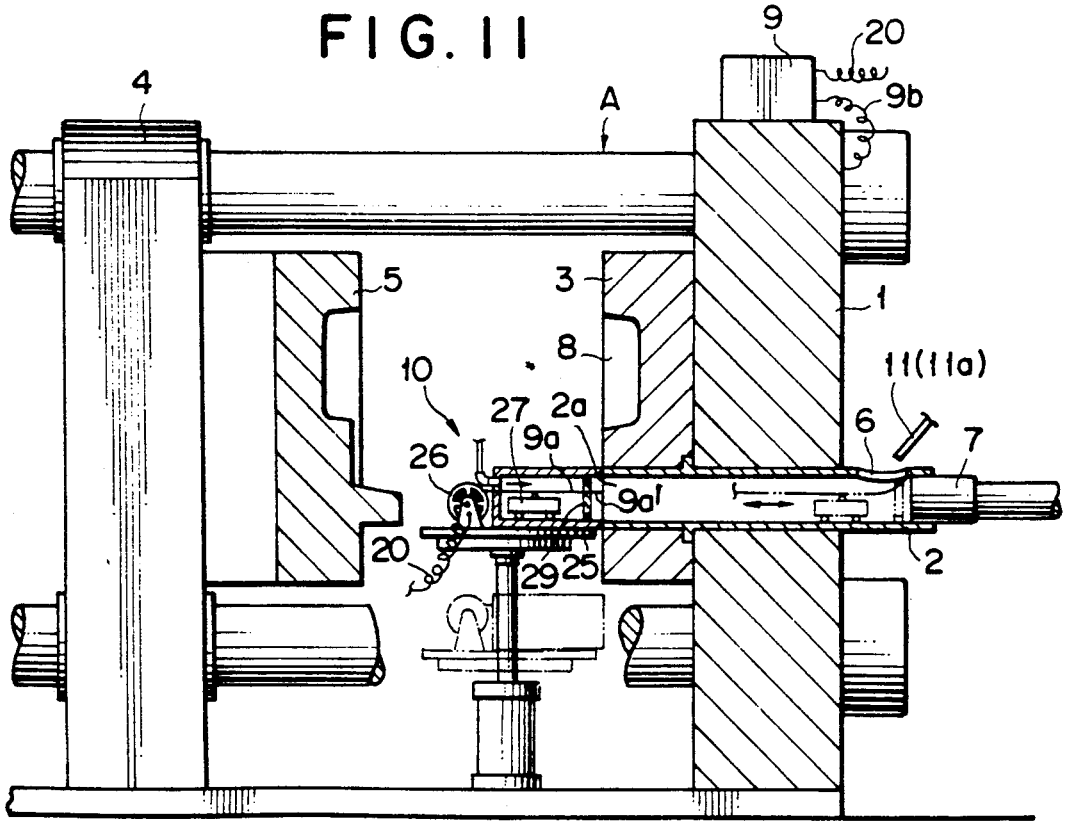

Referring to FIG. 11 which shows a fifth preferred embodiment of the present invention as modified from the second preferred embodiment, the conveyor vehicle 27 is driven by air in an air cylinder. In a further modified form, the free end 9'*a* of the electrode 9*a* may be directly connected to a piston 29 of the air cylinder. In this case, the conveyor vehicle 27 is unnecessary.

In the above-mentioned second to fifth preferred embodiments, after the electrode 9*a* is inserted into the injection sleeve 2, the heat insulating powder is blasted into the injection sleeve 2 by the heat insulating powder supplying mechanism 11 (the nozzle 11*a*). After or during blasting of the heat insulating powder, a high voltage is applied between the inner surface of the injection sleeve 2 and the electrode 9*a*. Alternatively, while the electrode 9*a* inserted into the injection sleeve 2 is pulled by rewinding the same around the reel 26 and simultaneously the heat insulating powder is blasted into the injection sleeve 2, the high voltage may be applied between the inner surface of the injection sleeve 2 and the electrode 9*a*. In the latter case, only the free end 9'*a* of the electrode 9*a* can be made serve as an effective discharging electrode. Furthermore, when the heat insulating powder is blasted from the molten metal inlet 6 of the injection sleeve 2, and is simultaneously sucked from the injection opening 2*a*, the electrostatic coating may be made more uniform and clean.

Figure 12:
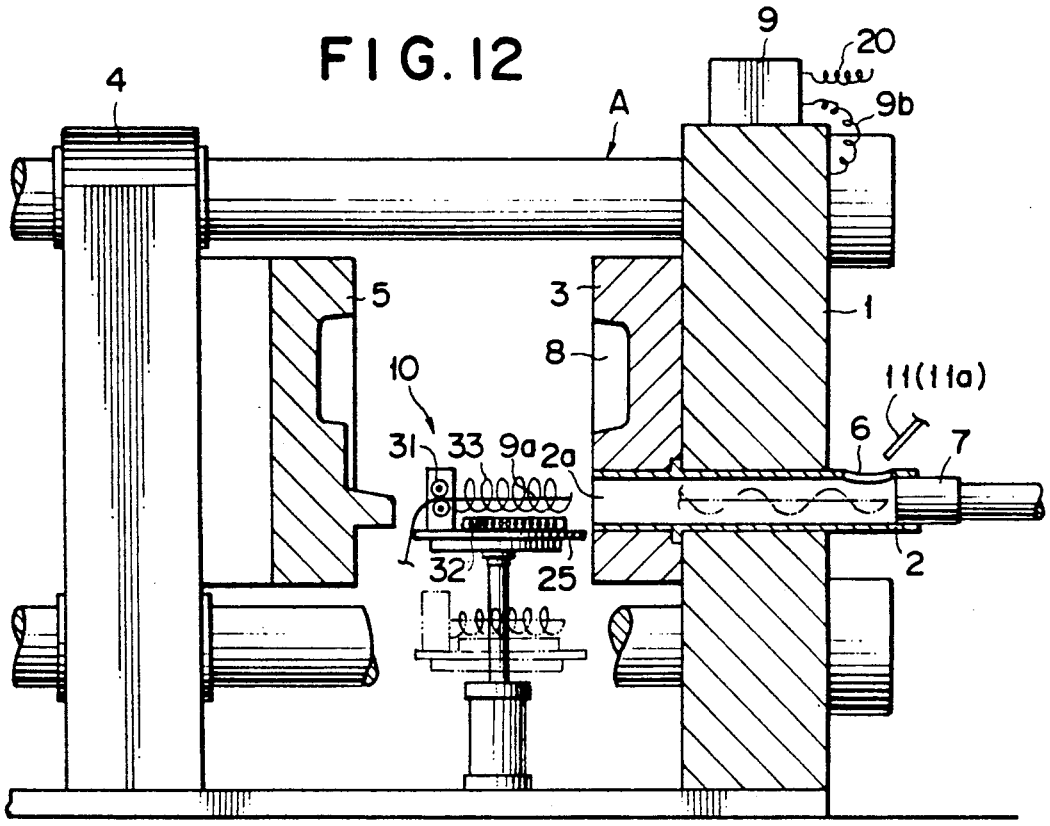

Referring to FIG. 12 which shows a sixth preferred embodiment, the electrode moving mechanism 10 includes an electrode feeder 31 for feeding the electrode 9*a*, a coil 33 formed of a shape memory alloy, and a heater 32 for heating the coil 33. The electrode feeder 31 and the heater 32 are fixedly mounted on the lift table 25, and the coil 33 is disposed over the heater 32. The coil 33 is connected at its one end to the electrode feeder 31, and is connected at the other end to the free end of the electrode 9a. In operation, when the coil 33 is heated by the heater 32, it expands to advance the electrode 9a into the injection sleeve 2 from the injection opening 2a. Conversely, when the coil 33 is cooled, it contracts to its normal condition to retract the electrode 9a out of the injection sleeve 2.

Figure 13:
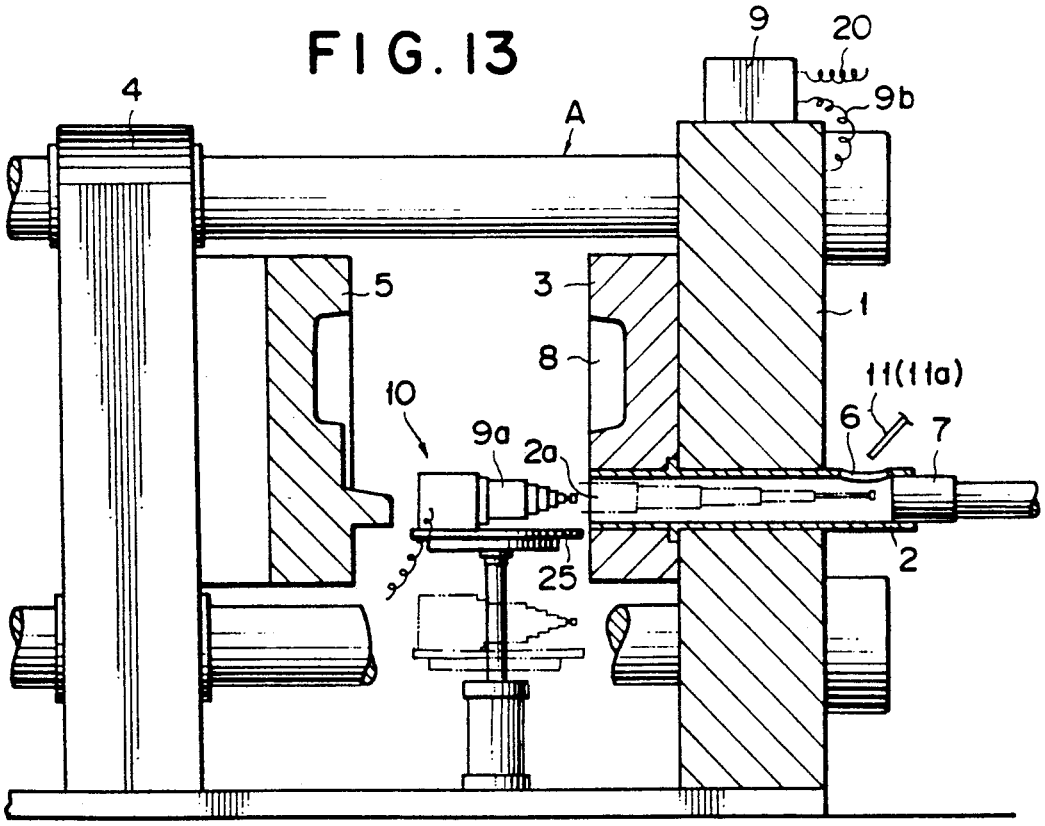

Referring to FIG. 13 which shows a seventh preferred embodiment, the electrode 9a connected through the cord 20 to the high-voltage generator 9 is so formed as to be telescopically expandable, so that the electrode 9a mounted on the lift table 25 may be expanded to advance into the injection sleeve 2 from the injection opening 2a.

Figure 14:
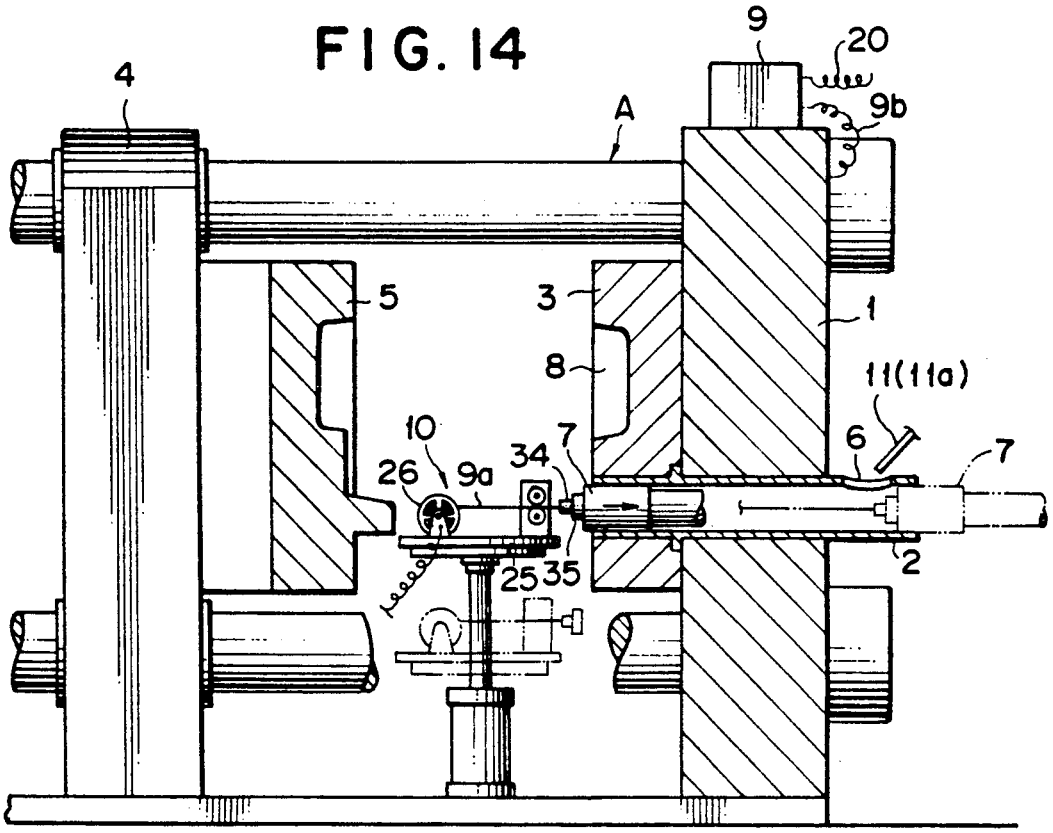

Referring to FIG. 14 which shows an eighth preferred embodiment, a magnet 35 is mounted through an electrical insulating member 34 to the free end of the electrode 9a wound around the reel 26 on the lift table 25. In inserting the electrode 9a into the injection sleeve 2, the magnet 35 is magnetically attached to the plunger tip 7 advanced as shown, and the plunger tip 7 is drawn into the injection sleeve 2, thereby inserting the electrode 9a into the injection sleeve 2.

Figure 15:
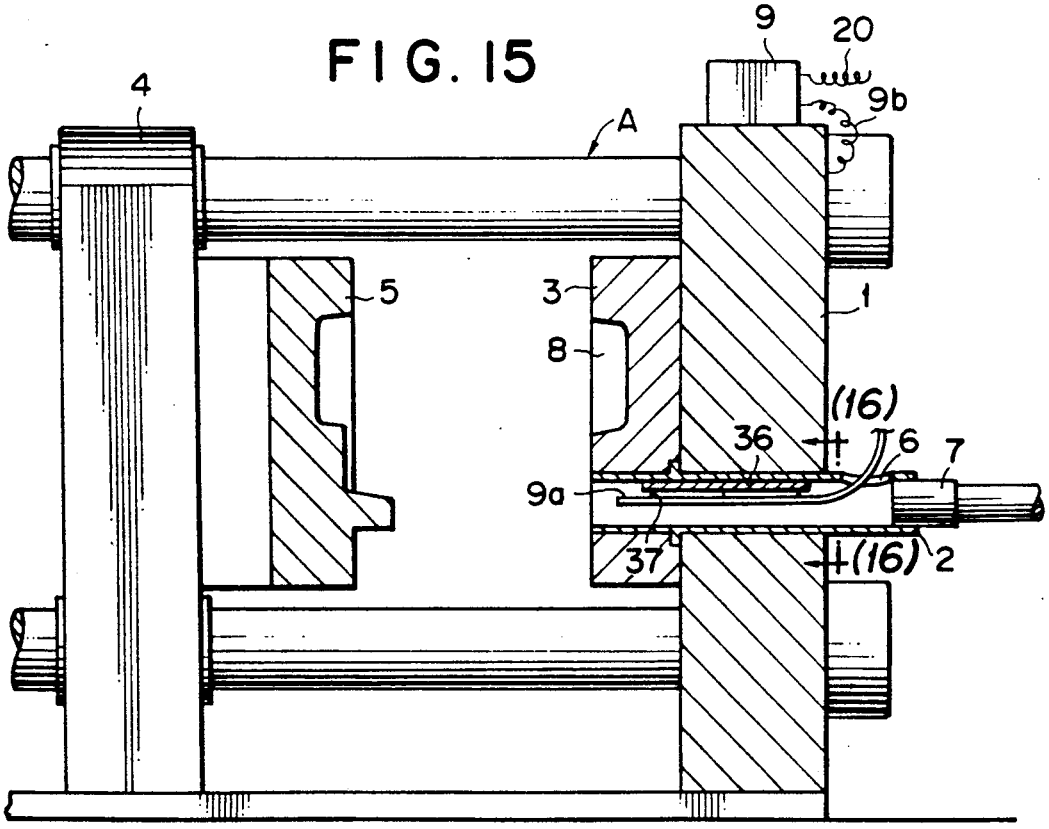
Figure 16:
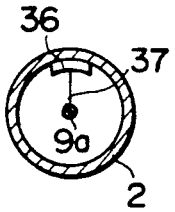
FIG. 16 is a cross section taken along the line (16)—(16) in FIG. 15.

Referring to FIGS. 15 and 16 which show a ninth preferred embodiment, the electrode 9a inserted from the molten metal inlet 6 into the injection sleeve 2 is supported through an electrical insulating member 37 to a belt-like elongated magnet plate 36 magnetically attached to the inner surface of the injection sleeve 2.

Figure 17:
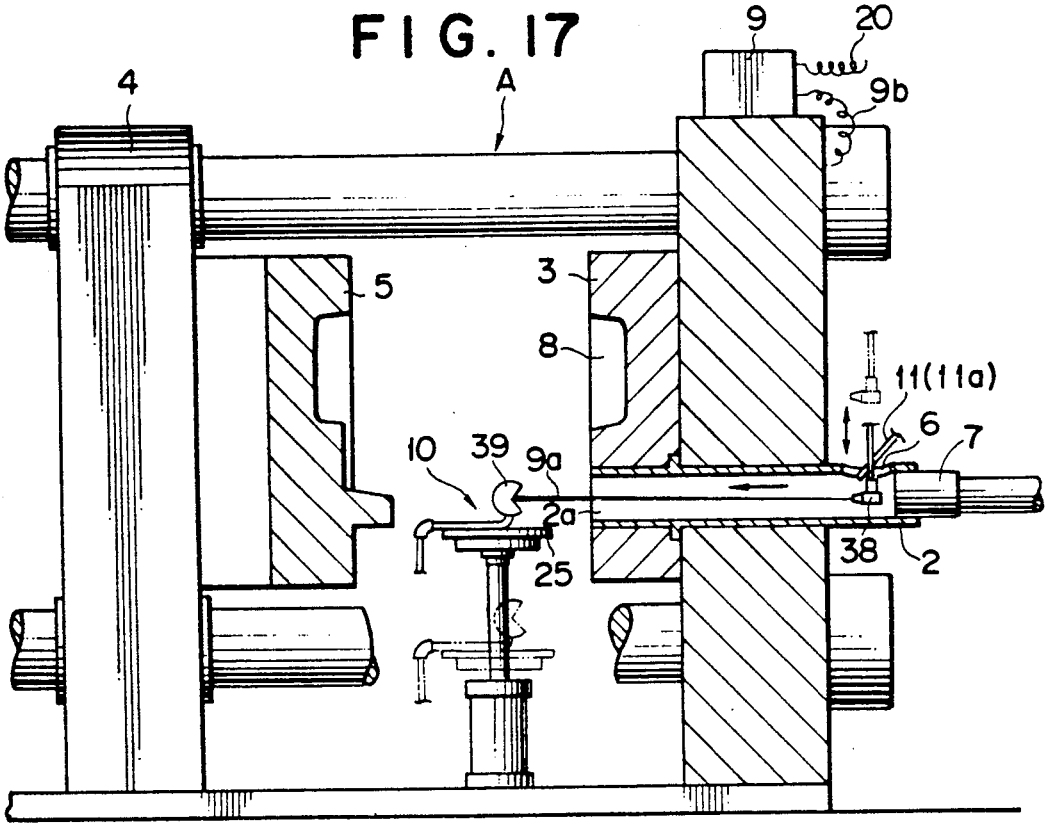

Referring to FIG. 17 which shows a tenth preferred embodiment, a water injection nozzle 38 is so provided as to be inserted from the molten metal inlet 6 into the injection sleeve 2, and a water receiver 39 for receiving a water jet to be injected from the water injection nozzle 38 is mounted on the lift table 25. Thus, the needle-like water jet formed in the injection sleeve 2 is utilized as the electrode 9a.

Referring to FIG. 18 which shows an eleventh preferred embodiment, the electrode 9a is so provided as to pass through the movable die 5 and project from a separator 5a of the movable die 5. The electrode 9a is connected at its base through an electrically insulating coupling 41 to a driving cylinder 40, and is retained through an electrically insulating support 42 in a bore formed through the movable die 5. With this construction, after both the dies 3 and 5 are closed, the electrode 9a is driven by the driving cylinder 40 to advance into the injection sleeve 2 from the injection opening 2a. Thereafter, the heat insulating powder is blasted into the injection sleeve 2.

Referring to FIG. 19 which shows a twelfth preferred embodiment, the electrode 9a is supported at its base portion in the plunger tip 7, so that the electrode 9a may project from and retract into the plunger tip 7.

According to the heat retaining method of the present invention, the following effects may be exhibited.

(1) The formation of the heat insulating layer formed by the heat insulating powder coated on the inner surface of the injection sleeve prevents direct contact of the molten metal with the inner surface of the injection sleeve after the molten metal is supplied into the injection sleeve. Additionally, the heat insulating and retaining property of the heat insulating layer consisting of the heat insulating powder and the air gap contributes to heat retention of the molten metal in the injection sleeve and prevents hardening thereof for a given period of time (several seconds at most) until the molten metal is injected into the cavity of the die. Accordingly, in injecting the molten metal into the cavity of the die, the run of the molten metal may be improved to prevent scattering. Further, since an injection speed may be largely reduced, there is no possibility of gas being drawn into the molten metal, thereby preventing the generation of blow hole or pin hole. Therefore, it is possible to produce castings having a high and constant quality.

(2) As rapid temperature shock of the injection sleeve during the course of receiving of the molten metal, injecting of the molten metal and resting can be relaxed, the life of the injection sleeve can be greatly extended.

(3) In the case that a self-lubricating powder is used as the heat insulating powder, a lubricating step and an air blowing step for the injection sleeve may be omitted to thereby shorten a casting time.

Furthermore, according to the coating method and the coating device of the present invention, the heat insulating powder may be deposited easily, reliably and uniformly onto the inner surface of the injection sleeve by the electrostatic force.

We claim:

1. In a casting device which includes an injection sleeve to be supplied with a molten metal and a die defining a cavity into which said molten metal is injected from said injection sleeve, a method comprising the steps of inserting a first electrode connected to a high-voltage generator into said injection sleeve, electrically connecting a second electrode to said injection sleeve, conveying a heat insulating powder into said injection sleeve, and generating an electrostatic field between said first electrode and said injection sleeve to thereby charge said heat insulating powder in said injection sleeve, whereby said heat insulating powder is deposited onto said inner surface of said injection sleeve.

2. In a casting device including an injection sleeve to be supplied with a molten metal, and a die defining a cavity into which said molten metal is injected from said injection sleeve; a device for applying a heat insulating powder onto an inner surface of said injection sleeve, comprising a high-voltage generator, positive and negative electrodes connected to said high-voltage generator, an electrode moving mechanism for moving one of said electrodes into and out of said injection sleeve, and a heat insulating powder supplying mechanism for supplying said heat insulating powder into said injection sleeve, wherein the other electrode is electrically connected to said injection sleeve, and an electrostatic field is generated by said high-voltage generator between said inner surface of said injection sleeve and said one electrode inserted into said injection sleeve by said electrode moving mechanism to thereby deposit said heat insulating powder supplied into said injection sleeve by said supplying mechanism onto said inner surface of said injection sleeve.

3. A method of injection molding with a casting device that includes a cavity and an injection sleeve into which molten metal is supplied for injection into said cavity, said injection sleeve having an inner surface, said method comprising the steps of (a) supplying a heat insulating powder onto said injection sleeve, (b) simultaneously or subsequent to step (a), creating an electrostatic field within said injection sleeve such that said heat insulating powder will form a coating on said inner surface of said injection sleeve, (c) supplying molten metal into said injection sleeve, said heat insulating powder on the inner surface of said injection sleeve preventing too rapid cooling of the molten metal, (d) injecting said molten metal from said injection sleeve into said cavity to form a cast product, and (e) repeating steps (a), (b), (c) and (d) to produce another cast product.

* * * * *